US009526152B1

(12) United States Patent
Toomey et al.

(10) Patent No.: US 9,526,152 B1
(45) Date of Patent: Dec. 20, 2016

(54) ROCK LANDSCAPE LIGHTING SYSTEM

(71) Applicant: Off Grid Technologies, LLC, East Bethlehem, PA (US)

(72) Inventors: Joseph Toomey, Pittsburgh, PA (US); Harry Lee Wainwright, Monessen, PA (US)

(73) Assignee: Off Grid Technologies, LLC, Bethelhem, PA (US)

( * ) Notice: Subject to any disclaimer, the term of this patent is extended or adjusted under 35 U.S.C. 154(b) by 0 days.

(21) Appl. No.: 14/545,855

(22) Filed: Jun. 23, 2015

Related U.S. Application Data

(60) Provisional application No. 61/998,312, filed on Jun. 25, 2014.

(51) Int. Cl.

| | |
|---|---|
| ***H05B 37/02*** | (2006.01) |
| ***F21V 31/00*** | (2006.01) |
| ***F21V 5/04*** | (2006.01) |
| ***F21S 6/00*** | (2006.01) |
| ***H05B 33/08*** | (2006.01) |
| *F21Y 101/02* | (2006.01) |
| *F21W 131/109* | (2006.01) |

(52) U.S. Cl.
CPC ..... *H05B 37/0272* (2013.01); *F21S 6/004* (2013.01); *F21V 5/048* (2013.01); *F21V 31/005* (2013.01); *H05B 33/0809* (2013.01); *H05B 33/0842* (2013.01); *F21W 2131/109* (2013.01); *F21Y 2101/02* (2013.01)

(58) Field of Classification Search
CPC ..... H05B 37/0272; H05B 33/0809; H05B 33/0842; F21W 2131/10; F21W 2131/20; F21Y 2131/20
USPC ..... 315/200 R, 294
See application file for complete search history.

(56) References Cited

U.S. PATENT DOCUMENTS

| | | | | |
|---|---|---|---|---|
| 5,526,243 | A * | 6/1996 | Masters | F21V 17/02 362/122 |
| 5,803,594 | A * | 9/1998 | Fredrickson | F21S 8/032 362/351 |
| 6,547,589 | B2 * | 4/2003 | Magyar | H02G 3/121 439/535 |
| 7,175,793 | B1 * | 2/2007 | Reed | B28B 7/346 264/220 |
| D580,085 | S | 11/2008 | Svensson | |

(Continued)

FOREIGN PATENT DOCUMENTS

CN 202008079 U 10/2011

*Primary Examiner* — Don Le
(74) *Attorney, Agent, or Firm* — Thomas M. Joseph, Esq.

(57) ABSTRACT

A landscape lighting system includes a lighting assembly having a tubular housing formed from a rock mass with a bore therein and having a light source with the ability to emit light having at least one color. The light source being positioned within the bore to project the light from the lighting assembly. An AC-to-DC converter connects to an external AC power supply and for supplying direct current to the light source within the lighting assembly. A control unit has a receiver and an internal controller for controlling the AC-to-DC converter and the light source to regulate the intensity and the color of the light emitted from the light source. A remote unit communicates with the control unit receiver to transmit instructions to the internal controller over a distance. Optionally, the landscape lighting system includes a mechanism to adjust the beam spread from the light source.

20 Claims, 5 Drawing Sheets

(56) References Cited

U.S. PATENT DOCUMENTS

| | | | | |
|---|---|---|---|---|
| D599,050 | S | 8/2009 | Guiercio | |
| D603,077 | S | 10/2009 | Kinnune et al. | |
| 7,736,703 | B1 | 6/2010 | Schofield et al. | |
| D639,997 | S | 6/2011 | Hashimoto | |
| 8,066,398 | B2 | 11/2011 | Hartman | |
| D650,109 | S | 12/2011 | Maxik et al. | |
| 8,079,744 | B2 | 12/2011 | Tsao et al. | |
| D658,599 | S | 5/2012 | Takahashi et al. | |
| D659,890 | S | 5/2012 | Kong et al. | |
| D663,442 | S | 7/2012 | Tickner et al. | |
| D663,469 | S | 7/2012 | Lee et al. | |
| D664,705 | S | 7/2012 | Kong et al. | |
| 8,267,451 | B2 | 9/2012 | Pedrazzini | |
| D671,257 | S | 11/2012 | Kong | |
| D672,494 | S | 12/2012 | Kong | |
| D672,905 | S | 12/2012 | Kong | |
| 8,328,397 | B2 | 12/2012 | Long | |
| D673,712 | S | 1/2013 | Patel | |
| D679,047 | S | 3/2013 | Tickner et al. | |
| D683,066 | S | 5/2013 | Myung | |
| D686,763 | S | 7/2013 | Song | |
| D687,176 | S | 7/2013 | Degn | |
| D687,585 | S | 8/2013 | Kim et al. | |
| D688,403 | S | 8/2013 | Landefeld | |
| D688,405 | S | 8/2013 | Kim et al. | |
| 8,505,859 | B2 | 8/2013 | Leung et al. | |
| 8,517,566 | B2 | 8/2013 | Gordin | |
| 8,602,613 | B2 | 12/2013 | Pike et al. | |
| D699,880 | S | 2/2014 | Szoke | |
| D699,886 | S | 2/2014 | Wilke et al. | |
| 8,651,686 | B2 | 2/2014 | Beukema et al. | |
| 8,672,502 | B2 | 3/2014 | Hartman | |
| D702,868 | S | 4/2014 | Patel | |
| D704,877 | S | 5/2014 | Szoke | |
| D705,979 | S | 5/2014 | Li et al. | |
| D707,379 | S | 6/2014 | Reinoso | |
| 9,247,622 | B2 * | 1/2016 | Fredricks | H05B 37/0245 |
| 2005/0146874 | A1 * | 7/2005 | Cech | F21S 8/081 362/253 |
| 2010/0141153 | A1 * | 6/2010 | Recker | H05B 33/0803 315/149 |
| 2011/0062888 | A1 * | 3/2011 | Bondy | H05B 33/0815 315/294 |
| 2012/0267953 | A1 * | 10/2012 | Doyle | H02M 1/44 307/31 |

* cited by examiner

ROCK LANDSCAPE LIGHTING SYSTEM

CROSS REFERENCE TO RELATED APPLICATION

This application claims the benefit under 35 U.S.C. §119 (e) of U.S. Provisional Application No. 61/998,312 entitled "REAL ROCK LIGHTS" filed Jun. 25, 2014, which is incorporated herein by reference.

BACKGROUND

Conventional outdoor landscape lighting fixtures or systems may be used to illuminate objects such as landscapes, bushes, trees, rock gardens, and fountains. These conventional systems may include quartz lighting systems, solar powered systems, and other conventional low power systems. Power consumption is an important issue with these systems because homeowners and other consumers who utilize such systems can incur substantial expenses. As a result, consumers recognize a need for more efficient lighting systems for economic and environmental reasons.

Quartz lighting systems typically utilize quartz light projectors and quartz lights, which are particularly inefficient with respect to power consumption. In fact, a single quartz fixture may only draw 40 watts of power at 12 VAC, and the typical lifespan for such a fixture is only 2-3 years before replacement is required. Quartz lights are also hot to touch and can burn skin with direct contact. Quartz light projectors do not have the ability to dim, to change colors on command, or to produce mood lighting.

Solar powered lighting fixtures, in particular, must be recharged and have a limited number of recharging cycles. Typically, solar cells are limited to 500-1000 recharging cycles, which limits their life to 2-4 years. These solar cells may have limited brightness, due to their storage capacity and ambient charging conditions, which may be insufficient to allow the solar cells to illuminate landscape trees, walls, or waterfalls.

Other drawbacks with conventional low power systems is the fact that they can be incompatible with existing systems that use conventional 12 VAC outdoor outlets. Similarly, conventional low power systems are typically mounted or stabilized using posts, stakes, or other means to ensure that they stay at desired positions in an outdoor environment. These systems may be unsightly, due to their inability to blend in with background environment, and may be disturbed by high winds, heavy rains, or animal accidents. The posts, stakes, etc. may be easy to spot and difficult to maneuver around when cutting lawns and trimming walkways.

Outdoor lighting systems often utilize artificial rocks that have artificial exteriors that include resins, artificial coloring, or other similar effects. These surfaces may be subject to bleaching, cracking, or other damage associated with outdoor exposure. The systems can include lightweight material that is insufficient to withstand high winds. These systems often include unsightly solar cells that can be damaged by outdoor exposure. These systems do not work under water or near waterfalls.

SUMMARY

The following summary is provided to introduce a selection of concepts in a simplified form that are further described below in the detailed description. This summary is not intended to identify key features or essential features of the claimed subject matter, nor is it intended to be used to limit the scope of the claimed subject matter.

In various implementations, a landscape lighting system includes a lighting assembly having a tubular housing formed from a rock mass with a bore therein and having a light source with the ability to emit light having at least one color. The light source being positioned within the bore to project the light from the lighting assembly. An AC-to-DC converter connects to an external AC power supply and for supplying direct current to the light source within the lighting assembly. A control unit has a receiver and an internal controller for controlling the AC-to-DC converter and the light source to regulate the intensity and the color of the light emitted from the light source. A remote unit communicates with the control unit receiver to transmit instructions to the internal controller over a distance. Optionally, the landscape lighting system includes a mechanism to adjust the beam spread from the light source.

These and other features and advantages will be apparent from a reading of the following detailed description and a review of the appended drawings. It is to be understood that the foregoing summary, the following detailed description and the appended drawings are explanatory only and are not restrictive of various aspects as claimed.

DETAILED DESCRIPTION

The detailed description provided below in connection with the appended drawings is intended as a description of examples and is not intended to represent the only forms in which the present examples may be constructed or utilized. The description sets forth functions of the examples and sequences of steps for constructing and/or operating the examples. However, the same or equivalent functions and sequences may be accomplished by different examples.

References to "one embodiment," "an embodiment," "an example embodiment," "one implementation," "an implementation," "one example," "an example" and the like, indicate that the described embodiment, implementation or example may include a particular feature, structure or characteristic, but every embodiment, implementation or example may not necessarily include the particular feature, structure or characteristic. Moreover, such phrases are not necessarily referring to the same embodiment, implementation or example. Further, when a particular feature, structure or characteristic is described in connection with an embodiment, implementation or example, it is to be appreciated that such feature, structure or characteristic may be implemented in connection with other embodiments, implementations or examples whether or not explicitly described.

Numerous specific details are set forth in order to provide a thorough understanding of one or more aspects of the described subject matter. It is to be appreciated, however, that such aspects may be practiced without these specific details. While certain components are shown in block diagram form to describe one or more aspects, it is to be understood that functionality performed by a single component may be performed by multiple components. Similarly, a single component may be configured to perform functionality described as being performed by multiple components.

Various aspects of the subject disclosure are now described in more detail with reference to the drawings, wherein like numerals generally refer to like or corresponding elements throughout. The drawings and detailed description are not intended to limit the claimed subject matter to the particular form described. Rather, the intention is to cover all modifications, equivalents and alternatives falling within the spirit and scope of the claimed subject matter.

Figure 1:
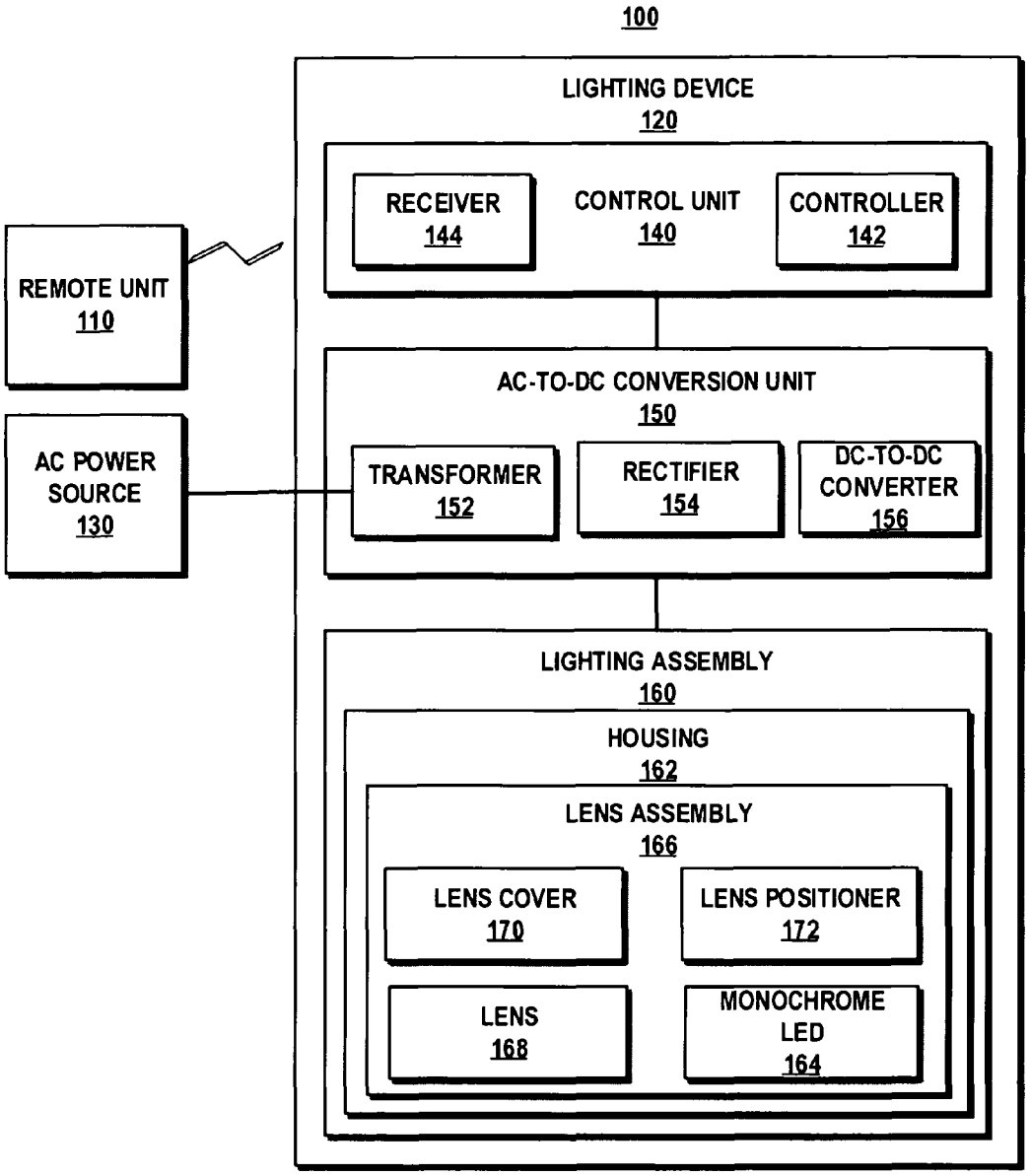
FIG. 1 illustrates an embodiment of an exemplary system that may implement aspects of the described subject matter.

FIG. 1 illustrates an outdoor lighting system 100 for illuminating a landscape. Lighting system 100 includes remote unit 110 and lighting device 120. Lighting device 120 connects to AC power source 130, which is typically an outdoor AC power outlet. Lighting device 120 may include control unit 140, AC-to-DC power conversion unit 150, and lighting assembly 160. AC-to-DC power conversion unit 150 receives electricity from AC power source 130, which is, preferably, a standard 110-120 VAC outlet.

Control unit 140 may include controller 142 and receiver 144. Receiver 144 receives a signal that contains instructions from remote unit 110 and transmits the instructions to controller 142. Controller 142 is a programmable controller that has the ability to control the operations of AC-to-DC power conversion unit 150 and lighting assembly 160.

AC-to-DC power conversion unit 150 may include drop down transformer 152, bridge rectifier 154, and DC-to-DC converter 156. Drop down transformer 152 is connected to AC power source 130. Preferably, drop down transformer 152, bridge rectifier 154, and DC-to-DC converter 156 are connected, so that electricity flows from drop down transformer 152 through bridge rectifier 154 and through DC-to-DC converter 156 to lighting assembly 160.

Lighting assembly 160 includes housing 162 and light source 164. Housing 162 is formed from a tubular rock mass. Light source 164 receives DC current electricity from AC-to-DC power conversion unit 150 and, preferably, from DC-to-DC converter 156 within AC-to-DC power conversion unit 150.

Lighting assembly 160 may include lens assembly 166 having lens 168, cover 170, and a mechanism for positioning the lens or lens positioner 172. Light source 164 is positioned within lens assembly 166, which is positioned within housing 162.

Referring to FIG. 1, remote unit 110 can be positioned at a distance from lighting device 120. Remote unit 110 can be physically connected to lighting device 120, but is, preferably, connected via an RF connection, an IR connection, a WIFI connection, a Bluetooth connection, ZigBee connection, a computer system connection, or other similar connection method. Remote unit 110 may include a conventional RF transmitter that is designed to control RGB light strips or other similar devices. Remote unit 110 may include a conventional WIFI receiver that is commonly used with smart phones.

Remote unit 110 has the ability to receive input from a human or computerized source and to convert the input into instructions that can be transmitted electrically, electronically, or any other similar method. Remote unit 110 may include a smart phone, such as an iphone or an Android based mobile phone. Remote unit 110 may include software to convert digital data to internal commands to drive the projection of light from system 100.

Remote unit 110 connects to lighting device 120 to send instructions to control unit 140 to produce lighting effects by light source 164. Control unit 140 connects to AC-to-DC power conversion unit 150 to facilitate the ability of controller 142 to control the flow of electricity through AC-to-DC power converter 150. Control unit 140 also controls the operation of light source 164 within lighting assembly 160.

Through control unit 140, remote unit 110 has the ability to control the color and intensity of projected light from light source 164. Remote unit 140 may utilize control unit 140 to display pre-programmed color-changing routines and audio-responsive light patterns projected from light source 164. The routines and patterns may accommodate personal tastes, seasonal color displays, or fulfill other purposes.

Control unit 140 may control the light intensities and color outputs of light source 164 to coincide with different amplitudes and/or frequencies of audio output so as to appear to display patterns of light synchronized to music.

As shown in FIG. 1, AC-to-DC power conversion unit 150 receives electrical power from AC power source 130, preferably in the form of a 110-120 VAC electrical signal, and converts the power into a low voltage DC current to power light source 164. Alternatively, AC-to-DC power conversion unit 150 may connect into an AC power source within a conventional low power landscape lighting system without the need of any intermediary equipment.

Control unit 140 has the ability to regulate and to vary the flow of electricity through AC-to-DC power conversion unit 150 and to control the emission of light from light source 164.

Light source 164 can be a monochrome light emitting diode or LED. Light source 164 may be embedded in silicon, a clear plastic, resin compound, or other similar transparent or translucent materials to prevent water and/or moisture from contact metal contact surfaces that allow light source 164 to receive electricity from AC-to-DC power conversion unit 150.

As shown in FIG. 1, light source 164 receives a DC current that has less than 4 Volts to allow housing 162 to be placed in water, submerged in water, or positioned in close proximity to water. AC-to-DC power conversion unit 150 receives an AC current having at least about 12 VAC and produces a direct current having about 4 V or less and, preferably, 3.7 V or less. This requirement ensures that light source 164 operates within a safe operating range.

AC-to-DC power conversion unit 150 uses rectifier 154 to produce the DC current and DC-to-DC converter 156 to reduce the voltage of the DC current to use with light source 164. DC-to-DC converter 156 may include an integrated circuit or a drop down resistor. Light source 164 may require that DC-to-DC converter 156 include a plurality of resistors with at least one resistor having distinct voltage value for each color that is emitted to ensure that the light source 164 operates within a safe range.

As shown in FIG. 1, lighting assembly 160 may include lens 168, which may be a clear lens to intensify the light emitted from light source 164 or a diffusing lens to adjust the light beam to spread the beam, as desired. If lens 168 is a diffusing lens, lens 168 must be fixed into place, optionally, by cover 170.

If lens 168 is a clear lens, cover 170 may be a movable cover having the ability to be moved into multiple positions along one or more axis, either permanently or temporarily to widen or narrow the beam spread. Similarly, lighting assembly 160 may include lens positioner 172 to move lens 168 and cover 170 into various positions.

Figure 2:
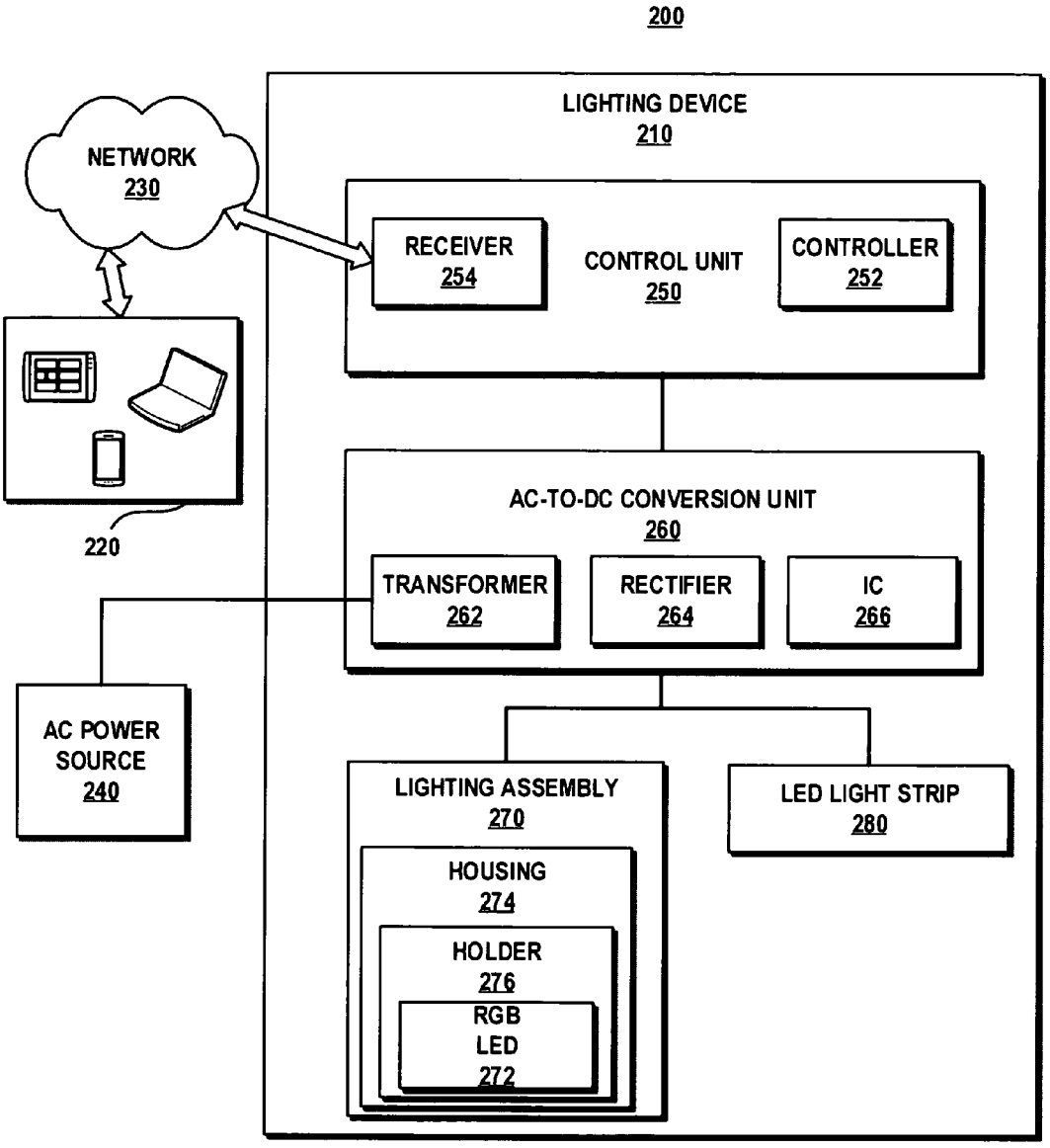
FIG. 2 illustrates an embodiment of an exemplary system that may implement aspects of the described subject matter.

Referring to FIG. 2 with continuing reference to the foregoing figures, lighting system 200 is illustrated as an embodiment of an exemplary outdoor landscape lighting system that may implement aspects of the described subject matter. It is to be appreciated that aspects of the described subject matter may be implemented by various types of outdoor landscape lighting systems, including lighting system 100 shown in FIG. 1.

Lighting system includes lighting device 210, which is a projector. Lighting device 210 connects to computing device 220 over network 230, so that computing device 220 can send instructions to lighting device 210 over network 230. Lighting device 210 connects to an AC power source 240 to receive power to power the device.

Lighting device 210 includes control unit 250, AC-to-DC power conversion unit 260, lighting assembly 270, and LED light strip 280. AC-to-DC power conversion unit 260 receives electricity from AC power source 240.

Control unit 250 may include RGB controller 252 and receiver 254. Receiver 254 receives a signal that contains instructions from computing device 220 and transmits the instructions to RGB controller 252. RGB controller 252 is a programmable controller that has the ability to control the operations of AC-to-DC power conversion unit 260, lighting assembly 270, and LED light strip 280.

RGB controller 252 can be an RGB controller with the ability to provide pulse width modulation (PWM). The use of PWM allows RGB controller 252 to adjust the frequency of pulses to RGB LED 272 and LED light strip 280 to blend discrete colors produced by the LEDs to form colors other than the three colors, red, blue, and green. The use of PWM also provides RGB controller 252 with the ability to modulate the frequency of pulses to RGB LED 272 and LED light strip 280 produce a lighting display by dimming or brightening of each color produced by the LEDs to form new colors and light intensities.

AC-to-DC power conversion unit 260 may include drop down transformer 262, bridge rectifier 264, and integrated circuit 266. Drop down transformer 262 is connected to AC power source 240. Preferably, drop down transformer 262, bridge rectifier 264, integrated circuit 266 are connected in a manner that allows electricity to flow from drop down transformer 262 to bridge rectifier 264 to integrated circuit 266. The DC current electricity flows from integrated circuit 266 to RGB LED 272 and LED light strip 280 that are positioned in parallel. Each RGB LED 272 and LED light strip 280 may be comprised of components that project a single color of light or may be an integrated component capable of producing multiple colors from a single structure.

Lighting assembly 270 includes RGB LED 272 and tubular housing 274 that has a bore extending there through. RGB LED 272 is mounted on holder 276 that is inserted into tubular housing 274. The use of an RGB light emitting diode allows lighting system 200 to project any one of 16 million colors.

Referring to FIG. 2, computing device 220 may be implemented by a mobile computing device such as: a mobile phone (e.g., a cellular phone, a smart phone such as a Microsoft® Windows® phone, an Apple iPhone, a BlackBerry® phone, a phone implementing a Google® Android™ operating system, a phone implementing a Linux® operating system, or other type of phone implementing a mobile operating system), a tablet computer (e.g., a Microsoft® Surface® device, an Apple iPad™, a Samsung Galaxy Note® Pro, or other type of tablet device), a laptop computer, a notebook computer, a netbook computer, a personal digital assistant (PDA), a portable media player, a handheld gaming console, a wearable computing device (e.g., a smart watch, a head-mounted device including smart glasses such as Google® Glass™, a wearable monitor, etc.), a personal navigation device, a vehicle computer (e.g., an on-board navigation system), a camera, or other type of mobile device.

Computing device 220 may include one or more client applications to control RGB LED 272 and LED light strip 280 by adjusting brightness, hues, colors, and other parameters, as desired. The applications may convert digital data into internal commands driving the intensities of the three colors produced by RGB LED 272 and LED light strip 280. The applications may produce pre-programmed routines that can be chosen from a list of available options that differ for each holiday, event, or personal tastes.

In one embodiment in which computing device 220 is a smartphone, computing device 220 may transmit a plurality of instructions in the form of predetermined routines associated with contact names from a list of contacts to display unique lighting effects to indicate who is calling the smartphone.

Figure 3:
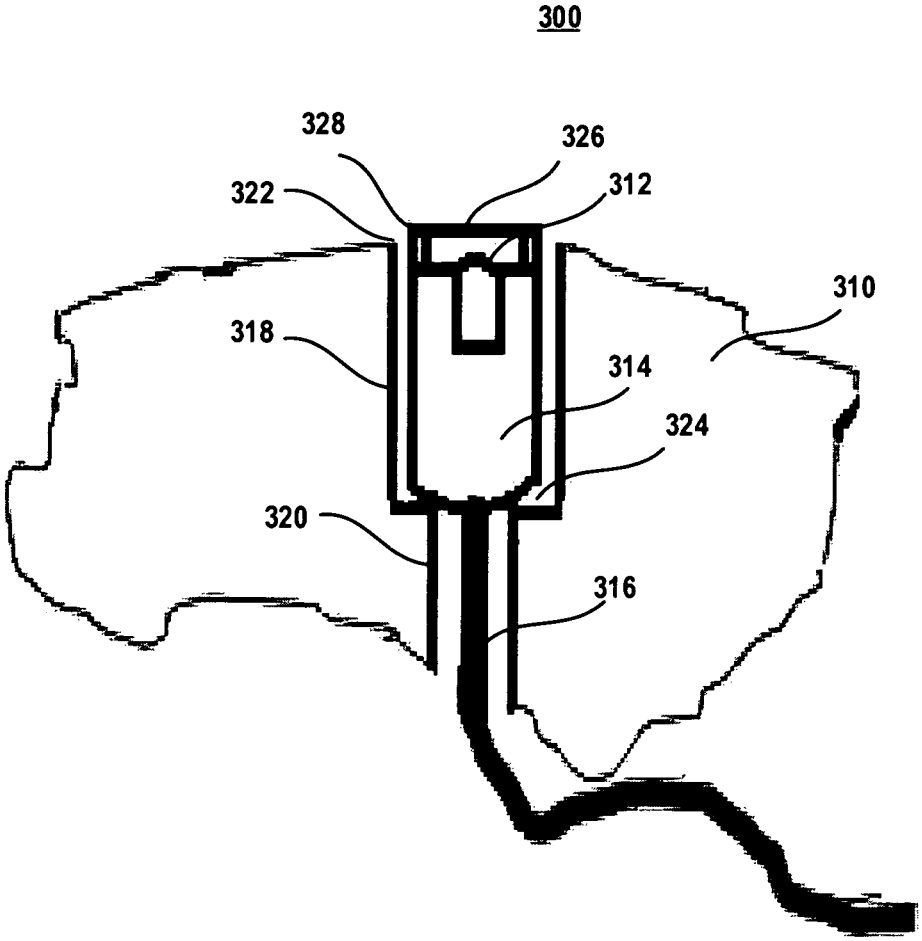
FIG. 3 illustrates a sectional view in side elevation of a lighting assembly that may implement aspects of the described subject matter.

Referring now to FIG. 3 with continuing reference to the foregoing figures, lighting assembly 300 is illustrated as an embodiment of an exemplary component of an outdoor landscape lighting system that may implement aspects of the described subject matter. It is to be appreciated that aspects of the described subject matter may be implemented by various types of outdoor landscape lighting systems, including lighting system 100 shown in FIG. 1 and lighting system 200 shown in FIG. 2.

Lighting assembly 300 may include housing 310, LED 312, cylindrical mount 314 for holding LED 312, and power cord 316. Housing 310 may include large bore 318 and small bore 320. In such an embodiment, LED 312 may be mounted in cylindrical mount 314 for insertion into large bore 318 in a vertical manner coaxially with large bore 318. Similarly, small bore 320. LED 312 may be positioned at opening 322 in housing 310 to allow LED 312 to project light therefrom.

Power cord 316 connects to cylindrical mount 314 at the opposite end of LED 312 and is electrically connected to LED 312. Power cord 316 extends from cylindrical mount 314 through large bore 318 and small bore 320 to project out of housing 310. Preferably, power cord 316 includes wire having a gage number of 16 AWG or higher (i.e. a gage of lower than 16 AWG), such as 22 AWG.

Large bore 318 has a larger diameter than small bore 320. However, small bore 320 has a greater depth than large bore 318, so that a base of large bore 318 forms shoulder 324 for supporting cylindrical mount 314 within housing 310.

Optionally, lighting assembly 300 includes diffusing lens 326 and lens cover 328 with lens cover 328 being positioned to allow LED 312 to project light through lens 326. Diffusing lens 326 may be removeably mounted or permanently mounted into lens cover 328 to protect LED 312.

Referring to FIG. 3, housing 310 may be formed from a tubular rock mass that is produced from a natural rock. The use of a natural rock ensures that housing 310 has a unique shape and natural appearance that, preferably, blends into the background of a landscape.

Each housing 310 may be formed using a rock mass that is subject to minimal processing. The use of a naturally formed rock ensures that housing 310 has an amorphous or an essentially amorphous shape with a natural, unfinished, and/or weathered outer surface. Housing 310 may be formed from igneous, metamorphic, or sedimentary rock or from one or more combinations thereof with minimal processing, other than washing, of the exterior surface.

Figure 4:
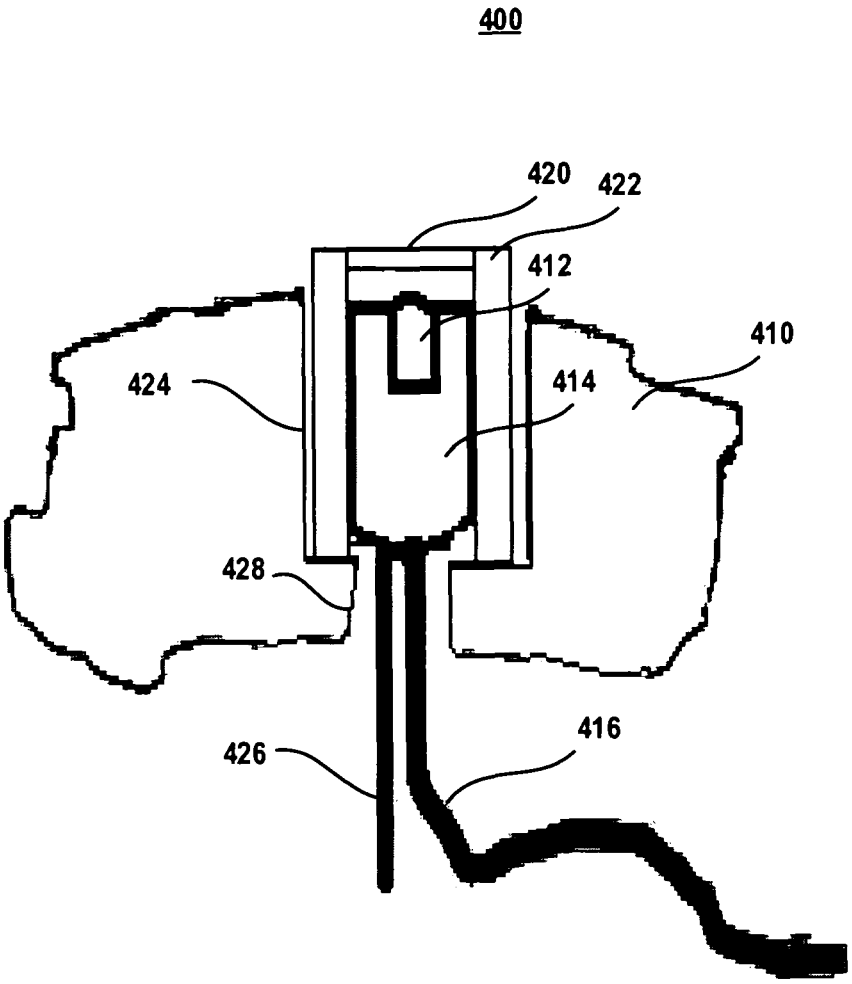
FIG. 4 illustrates a sectional view in side elevation of a lighting assembly having mechanism for adjusting the spread of a light beam that may implement aspects of the described subject matter.

Referring now to FIG. 4 with continuing reference to the foregoing figures, lighting assembly 400 is illustrated as an embodiment of an exemplary component of an outdoor landscape lighting system that may implement aspects of the described subject matter. It is to be appreciated that aspects of the described subject matter may be implemented by various types of outdoor landscape lighting systems, including lighting system 100 shown in FIG. 1 and lighting system 200 shown in FIG. 2.

Lighting assembly 400 includes housing 410, LED 412, cylindrical mount 414, and power cord 416, which are similar to housing 310, LED 312, cylindrical mount 314, and power cord 316, shown in FIG. 3 as components of lighting assembly 300. However, in contrast to lighting assembly 300 shown in FIG. 3, lighting assembly 400 also includes clear lens 420.

Clear lens 420 is mounted in a telescoping cylindrical tube 422, so that LED 412 projects light through the clear lens 420 and out of housing 410. Clear lens 420 may broaden or narrow the light beam emitted from LED 412

Cylindrical tube 422 is mounted in large bore 424 with the ability to slide in a vertical axis and is connected to wire 426, which is a generally rigid wire. Wire 426 extends through smaller bore 428.

Wire 426 may be manipulated to move telescoping cylindrical tube 422 closer to or further away from LED 412 until clear lens 420 is placed in a predetermined position in relation to LED 412. Once clear lens 420 is in the predetermined position, wire 426 can be bent around housing 310 to conform to the outer surface of housing 310 to lock clear lens 420 into the predetermined position relative to LED 412. Optionally, wire 426 is formed from a metal or metal alloy that can work hardened to lock clear lens 420 in place.

Similarly, wire 426 may be used as a heat sink to direct heat away from LED 412. This may be accomplished through the use of a material or combination of materials that have a high heat capacity. Alternatively, this may be accomplished by using a material or combination of materials that have a substantial mass.

Figure 5:
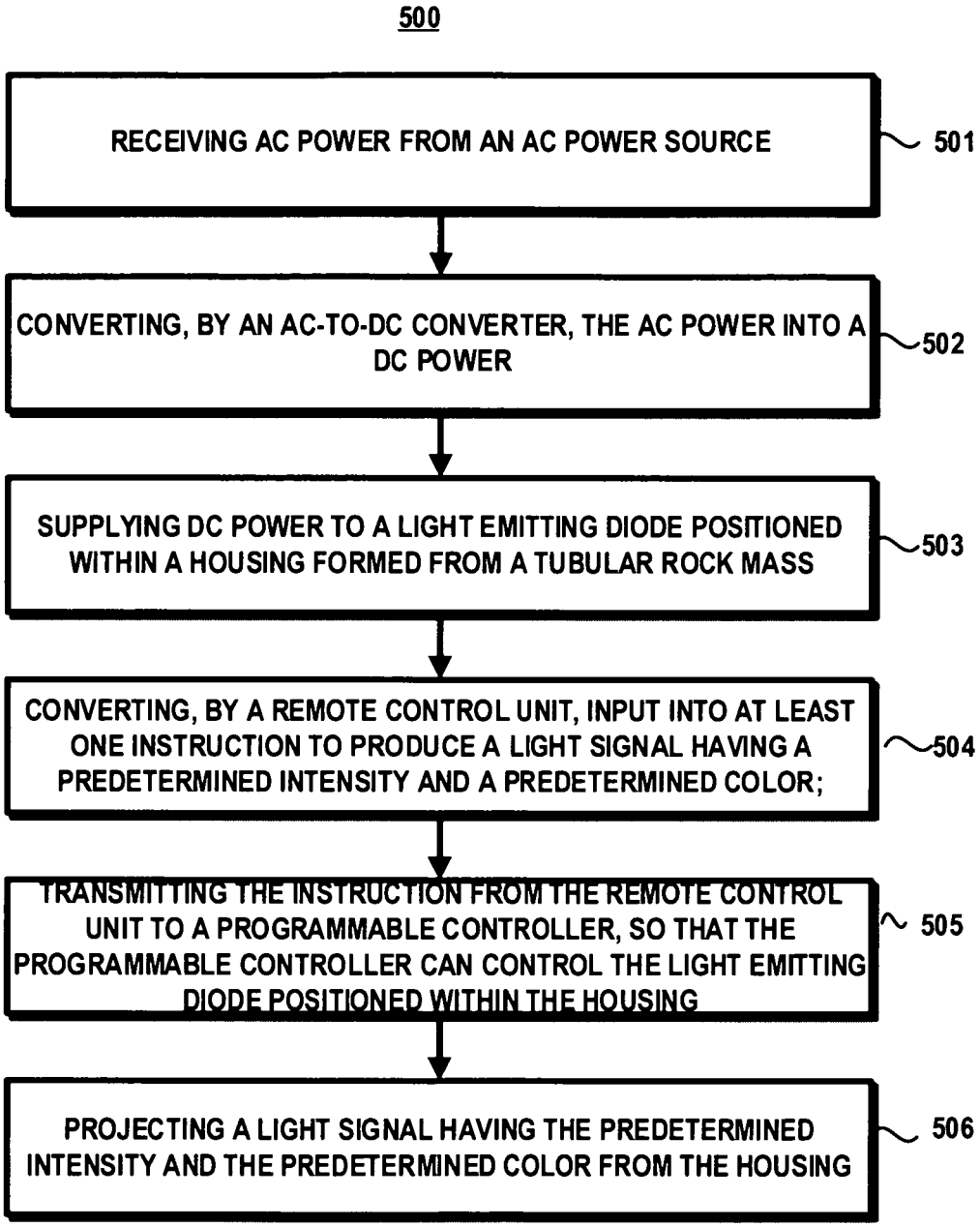
FIG. 5 illustrates an embodiment of an exemplary process in accordance with aspects of the described subject matter.

Referring to FIG. 5 with continuing reference to the foregoing figures, method 500 is an embodiment of an exemplary process is illustrated in accordance with aspects of the described subject matter. In various embodiments, method 500 may be performed by system 100 using remote unit 110 and lighting device 120, by system 200 using lighting device 210 and computing device 220, or by a projector that includes lighting assembly 300 or lighting assembly 400. It is to be appreciated that method 500, or portions thereof, may be performed by various devices, systems and/or components thereof.

At 501, a landscape lighting system may receive AC power from an AC power source. The AC power source may be any standard AC power outlet, such as AC power source 130 or AC power source 240. The AC power source may also be an AC power system in a conventional landscape lighting system.

At 502, the landscape lighting system may convert, using an AC-to-DC converter, the AC power into a DC power. The AC-to-DC converter include components of AC-to-DC conversion unit 150 or AC-to-DC conversion unit 260. Preferably, the AC-to-DC converter produces a low power DC current having a voltage of less than 4 V or, most preferably, less than 3.7 V.

At 503, the landscape lighting system may supply DC power to a light emitting diode positioned within a housing formed from a tubular rock mass. The light emitting diode may be the monochrome LED corresponding to light source 164, RGB LED 272, or any other suitable low power light source. The housing may be housing 162 or housing 274 formed from a natural rock mass having a substantially unfinished, weathered outer surface.

At 504, the landscape lighting system may convert, by a remote control unit, input into at least one instruction to produce a light signal having a predetermined intensity and a predetermined color. The remote control unit may be remote unit 110 or computing device 220. The remote control unit can be a remote control unit that is suitable for use in a conventional RF system, an IR system, a WIFI system, a Bluetooth system, ZigBee system, a mobile phone system, a computer system or other similar system.

At 505, the landscape lighting system may transmit the instruction from the remote control unit to a programmable controller, so that the programmable controller can control the light emitting diode positioned within the housing. The programmable controller may be a component of a control unit, such as control unit 140 or control unit 250.

At 506, the landscape lighting system may project a light signal having the predetermined intensity and the predetermined color from the housing. Depending upon the type of LED that is used, the landscape lighting system can project as many as 16 million colors. The system may project the colors based upon a predetermined routine or pattern, through random generation, or based upon input received by the remote control unit, which may be obtained in real-time, in near real-time, or based upon some predetermined delay factor.

Supported Aspects

The detailed description provided above in connection with the appended drawings explicitly describes and supports various aspects of landscape lighting in accordance with the described subject matter. By way of illustration and not limitation, supported aspects of a rock landscape lighting system include a landscape lighting system comprising: a lighting assembly having a tubular housing formed from a rock mass with a bore therein and having a light source with the ability to emit light having one or more colors; the tubular housing having the light source is positioned within the bore to project the light from the lighting assembly; an AC-to-DC converter for connecting to an external AC power supply and for supplying direct current to the light source within the lighting assembly; a control unit having a receiver and an internal controller for controlling the AC-to-DC converter and the light source to regulate the intensity and the color of the light emitted from the light source; and a remote unit for communicating with the control unit receiver to transmit instructions to the internal controller over a distance.

Supported aspects of a rock landscape lighting system include the forgoing landscape lighting system in which the remote unit is a computing device having an application residing thereon that converts input into instructions to transmit to the internal controller.

Supported aspects of a rock landscape lighting system include any of the forgoing landscape lighting systems in which the remote unit is a smartphone.

Supported aspects of a rock landscape lighting system include any of the forgoing landscape lighting systems in which the remote unit sends instructions in predetermined routine.

Supported aspects of a rock landscape lighting system include any of the forgoing landscape lighting systems in which the remote unit includes a microphone and speech recognition code.

Supported aspects of a rock landscape lighting system include any of the forgoing landscape lighting systems in which the AC-to-DC converter includes a bridge rectifier.

Supported aspects of a rock landscape lighting system include any of the forgoing landscape lighting systems that include a DC-to-DC converter for reducing the direct current to a predetermined voltage.

Supported aspects of a rock landscape lighting system include any of the forgoing landscape lighting systems in which the DC-to-DC converter is selected from the group consisting of a drop down resistor and an integrated circuit.

Supported aspects of a rock landscape lighting system include any of the forgoing landscape lighting systems in which the internal controller includes an RGB controller with the ability to provide pulse width modulation.

Supported aspects of a rock landscape lighting system include any of the forgoing landscape lighting systems in which the rock mass is a natural rock.

Supported aspects of a rock landscape lighting system include an apparatus, a device, a method, and/or means for implementing any of the foregoing systems or portions thereof.

Supported aspects include a landscape lighting projector comprising: a lighting assembly having a natural rock tubular housing having a bore extending therethrough and having a holder positioned within the bore having a light emitting diode positioned at one end and an electrical connector positioned at the other end; an AC-to-DC converter connected to the electrical connector; wherein the AC-to-DC converter has the ability to receive an AC current from an AC power supply and provide direct current to the light emitting diode through the electrical connector; and a programmable controller connected to the AC-to-DC controller to regulate the frequency modulation provided by the AC-to-DC converter to control the intensity and the color of light emitted from light emitting diode.

Supported aspects of a rock landscape lighting projector include the forgoing landscape lighting projector in which the light emitting diode is embedded in a waterproof case.

Supported aspects of a rock landscape lighting projector include any of the forgoing landscape lighting projectors in which the light emitting diode is selected from the group consisting of a monochrome light emitting diode and an RGB diode.

Supported aspects of a rock landscape lighting projector include any of the forgoing landscape lighting projectors that include a clear lens for adjusting the light emitted from the light emitting diode mounted on the holder; and a lens positioner for moving the clear lens mounted on the holder; wherein the lens positioner is a heat sink to draw heat away from the light emitting diode.

Supported aspects of a rock landscape lighting projector include any of the forgoing landscape lighting projectors that include a diffusing lens for blending the light emitted from the light emitting diode.

Supported aspects of a rock landscape lighting projector include any of the forgoing landscape lighting projectors which include a DC-to-DC converter for receiving direct current from the AC-to-DC converter and for providing a direct current having about 4V or less to the light emitting diode.

Supported aspects of a rock landscape lighting device include a system, an apparatus, a method, a device and/or means for implementing any of the foregoing projectors or portions thereof.

Supported aspects of a method for producing an outdoor lighting display include receiving AC power from an AC power source; converting, by an AC-to-DC converter, the AC power into a DC power; supplying DC power to a light emitting diode positioned within a housing formed from a tubular rock mass; converting, by a remote control unit, input into at least one instruction to produce a light signal having a predetermined intensity and a predetermined color; transmitting the instruction from the remote control unit to a programmable controller, so that the programmable controller can control the light emitting diode positioned within the housing; and projecting a light signal having the predetermined intensity and the predetermined color from the housing.

Supported aspects of rock landscape lighting method include the foregoing method, in which the remote unit is a smartphone having an application residing thereon that converts input into instructions to transmit to the programmable controller.

Supported aspects of rock landscape lighting method include any of the foregoing methods in which the remote control unit is a smartphone, further comprising: transmitting a plurality of instructions from the smartphone to the programmable controller in the form of predetermined routines associated with contact names from a list of contacts to display unique lighting effects to indicate who is calling the smartphone.

Supported aspects of a rock landscape lighting method include a system, an apparatus, a device, and/or means for implementing any of the foregoing methods or portions thereof.

It can be appreciated that features of a rock landscape lighting system, projector or method with the described embodiments provide various attendant and/or technical advantages. By way of illustration and not limitation, various features and implementations of landscape lighting in accordance with the described subject matter produces a rock landscape lighting system that has the ability to attach to and to be compatible with standard 12 VAC low voltage outdoor landscaping lighting systems. The use of naturally shaped rocks ensures that each unit has a unique appearance.

Various features and implementations provide other technical advantages, such as the emission of cold light, so that the system can be used in above, below, or in other proximity of water without special protection or mounting fixtures. Similarly, the system requires a fraction of power compared to conventional outdoor low-powered lighting systems. Specifically, a preferred embodiment of the system requires 0.02-1 Watt, as compared to the typical quartz lighting fixture, which uses 4 Watts.

Features of the landscape lighting system in accordance with aspects of the described subject matter allow users to choose the color of light output instantaneously and to adjust the intensity to their personal preference. These features are accomplished through the use of RF, IR, WIFI, Bluetooth or ZigBee remote controls or through the use of mobile phones, smartphones, computer systems, or other similar systems. These features allow the landscape lighting system to substitute for seasonal decoration lighting by simply using a remote control to change colors according to seasonal preferences. These features allow for the use of pre-programmed color-changing routines and audio-responsive light patterns.

Features of the landscape lighting system in accordance with aspects of the described subject matter provide for the use of a housing formed from an amorphous natural rock in its unfinished or essentially unfinished state. These features provide durable landscape lighting systems that are compatible with most landscapes, have a natural appearance, and achieve aesthetic beauty.

Features of the landscape lighting system in accordance with aspects of the described subject matter provide for the use of a landscape lighting system that is compatible with the power systems of other conventional landscape lighting systems.

Features of the landscape lighting system in accordance with aspects of the described subject matter provide for an adjustable beam spread to project light on a specific area to accent small bushes or large trees.

The detailed description provided above in connection with the appended drawings is intended as a description of examples and is not intended to represent the only forms in which the present examples may be constructed or utilized.

It is to be understood that the configurations and/or approaches described herein are exemplary in nature, and that the described embodiments, implementations and/or examples are not to be considered in a limiting sense, because numerous variations are possible. The specific processes or methods described herein may represent one or more of any number of processing strategies. As such, various operations illustrated and/or described may be performed in the sequence illustrated and/or described, in other sequences, in parallel, or omitted. Likewise, the order of the above-described processes may be changed.

Although the subject matter has been described in language specific to structural features and/or methodological acts, it is to be understood that the subject matter defined in the appended claims is not necessarily limited to the specific features or acts described above. Rather, the specific features and acts described above are presented as example forms of implementing the claims.

What is claimed is:

1. A landscape lighting system comprising:

a lighting assembly having a tubular housing formed from a rock mass with a bore therein and having a light source with the ability to emit light having one or more colors;

the tubular housing having the light source positioned within the bore to project the light from the lighting assembly;

an AC-to-DC converter for connecting to an external AC power supply and for supplying direct current to the light source within the lighting assembly;

a control unit having a receiver and an internal controller for controlling the AC-to-DC converter and the light source to regulate the intensity and the color of the light emitted from the light source;

a remote unit for communicating with the control unit receiver to transmit instructions to the internal controller over a distance; and positioning means for adjusting the light emitted from the light source mounted on the lighting assembly;

wherein positioning means has the ability to draw heat away from the light source.

2. The landscape lighting system of claim 1, wherein the remote unit is a remote control selected from the group consisting of a RF remote control, an IR remote control, a WIFI remote control, a Bluetooth remote control and a ZigBee remote control.

3. The landscape lighting system of claim 1, wherein the remote unit is a computing device having an application residing thereon that converts input into instructions to transmit to the internal controller.

4. The landscape lighting system of claim 3, wherein the remote unit is a smartphone.

5. The landscape lighting system of claim 1, wherein the remote unit sends instructions in a predetermined routine.

6. The landscape lighting system of claim 1, wherein the remote unit includes a microphone and speech recognition code.

7. The landscape lighting system of claim 1, wherein the AC-to-DC converter includes a bridge rectifier.

8. The landscape lighting system of claim 1, which includes a DC-to-DC converter for reducing the direct current to a predetermined voltage.

9. The landscape lighting system of claim 8, wherein the DC-to-DC converter is selected from the group consisting of a drop down resistor and an integrated circuit.

10. The landscape lighting system of claim 1, wherein the internal controller includes an RGB controller with the ability to provide pulse width modulation.

11. The landscape lighting system of claim 1, wherein the rock mass is a natural rock.

12. A landscape lighting projector comprising:

a lighting assembly having a natural rock tubular housing having a bore extending therethrough and having a holder positioned within the bore having a light emitting diode positioned at one end and an electrical connector positioned at the other end;

an AC-to-DC converter connected to the electrical connector;

wherein the AC-to-DC converter has the ability to receive an AC current from an AC power supply and provide direct current to the light emitting diode through the electrical connector;

a programmable controller connected to the AC-to-DC controller to regulate the frequency modulation provided by the AC-to-DC converter to control the intensity and the color of light emitted from light emitting diode;

a clear lens for adjusting the light emitted from the light emitting diode mounted on the holder; and a lens positioner for moving the clear lens mounted on the holder;

wherein the lens positioner is a heat sink to draw heat away from the light emitting diode.

13. The landscape lighting projector of claim 12, wherein the light emitting diode is embedded in a waterproof case.

14. The landscape lighting projector of claim 12, wherein the light emitting diode is selected from the group consisting of a monochrome light emitting diode and an RGB diode.

15. The landscape lighting projector of claim 12, further comprising:

a DC-to-DC converter for receiving direct current from the AC-to-DC converter and or providing a direct current having about 4V or less to the light emitting diode.

16. A method for producing an outdoor lighting display comprising:

receiving AC power from an AC power source;

converting, by an AC-to-DC converter, the AC power into DC power;

supplying DC power to a light source positioned within a housing formed from a tubular rock mass;

converting, by a remote control unit, input into at least one instruction to produce a light signal having a predetermined intensity and a predetermined color;

transmitting the instruction from the remote control unit to a programmable controller, housing;

projecting the light signal from the housing;

adjusting the light emitted from the light source positioned within the housing; and drawing heat away from the light emitting diode.

17. The method of claim 16, wherein the remote control unit is a computing device having an application residing thereon that converts input into instructions to transmit to the programmable controller.

18. The method of claim 17 in which the computing device is a smartphone, further comprising:

transmitting from the smartphone to the programmable controller a plurality of instructions in the form of predetermined routines associated with contact names from a list of contacts to display unique lighting effects to indicate who is calling the smartphone.

19. The method of claim 16 in which the remote control unit is a remote control unit selected from the group consisting of a RF remote control, an IR remote control, a WIFI remote control, a Bluetooth remote control and a ZigBee remote control.

20. The method of claim 17, wherein the light source is a light emitting diode.

* * * * *